US006185389B1

(12) United States Patent
Bartley et al.

(10) Patent No.: US 6,185,389 B1
(45) Date of Patent: Feb. 6, 2001

(54) CONTROL OF THERMAL HEATING IN A BELT FUSER

(75) Inventors: Brian Keith Bartley; James Douglas Gilmore; Cyrus Bradford Clarke; Douglas Campbell Hamilton, all of Lexington; Kevin D. Schoedinger, Nicholasville, all of KY (US)

(73) Assignee: Lexmark International, Inc., Lexington, KY (US)

( * ) Notice: Under 35 U.S.C. 154(b), the term of this patent shall be extended for 0 days.

(21) Appl. No.: 09/494,029

(22) Filed: Jan. 28, 2000

(51) Int. Cl.[7] ..... G03G 15/20
(52) U.S. Cl. ..... 399/69
(58) Field of Search ..... 399/69, 67, 328, 399/329; 219/216

(56) References Cited

U.S. PATENT DOCUMENTS

| | | | |
|---|---|---|---|
| 5,289,247 | 2/1994 | Takano et al. | 355/285 |
| 5,315,350 | 5/1994 | Hirobe et al. | 355/208 |
| 5,621,511 | 4/1997 | Nakayama | 399/44 |
| 5,669,039 | 9/1997 | Ohtsuka et al. | 399/68 |

FOREIGN PATENT DOCUMENTS 63-231383 * 9/1988 (JP) .

8-190303 * 7/1996 (JP) .

* cited by examiner

*Primary Examiner*—Quana M. Grainger
(74) *Attorney, Agent, or Firm*—John A. Brady; Frost & Jacobs LLP

(57) ABSTRACT

An electrophotographic printing apparatus which eliminates overheating of the fuser belt when narrow gauge print media is utilized is disclosed. In this apparatus, a detection means determines whether a sheet of narrow gauge recording medium is being fed into the printer. When it is, the fuser heater is deactivated turned to a present lower temperature or is turned off when the narrow gauge recording medium exits the fusing nip. A preferred apparatus additionally contains means which measures the temperature of the heater once it is deactivated at predetermined intervals and, for each measurement, determines the amount of time required to bring the heater back up to the optimum fusing temperature. The preferred embodiment also includes a means for determining the amount of time it will take for the next piece of print media to travel from its current position to the fuser nip. This preferred embodiment then reactivates the heater when the time required to bring it back up to the fusing temperature is greater than or equal to the amount of time it will take the next piece of print medium to enter the fusing nip. This apparatus prevents overheating of the fuser belt which can accompany the use of narrow gauge print media. The application also discloses a method for fixing images using this apparatus.

18 Claims, 3 Drawing Sheets

CONTROL OF THERMAL HEATING IN A BELT FUSER

TECHNICAL FIELD

This invention relates to electrophotographic processes and, particularly, the control of thermal heating in the fuser portion of an electrophotographic device when narrow print media, such as envelopes, are fed through the system.

BACKGROUND OF THE INVENTION

In electrophotography, a latent image is created on the surface of an insulating, photoconducting material by selectively exposing an area of the surface to light. A difference in electrostatic density is created between the areas on the surface exposed and those unexposed to the light. The latent electrostatic image is developed into a visible image by electrostatic toners which contain pigment components and thermoplastic components. The toners, which may be liquids or powders, are selectively attracted to the photoconductor's surface, either exposed or unexposed to light, depending upon the relative electrostatic charges on the photoconductor's surface, development electrode and the toner. The photoconductor may be either positively or negatively charged, and the toner system similarly may contain negatively or positively charged particles.

A sheet of paper or intermediate transfer medium is given an electrostatic charge opposite that of the toner and then passed close to the photoconductor's surface, pulling the toner from the photoconductor's surface onto the paper or intermediate medium still in the pattern of the image developed from the photoconductor's surface. A set of fuser rolls or belts, under heat, melts and fixes the toner in the paper subsequent to transfer, producing the printed image.

The electrostatic printing process, therefore, comprises an intricate and ongoing series of steps in which the photoconductor's surface is charged and discharged as the printing takes place. In addition, during the process, various charges are formed on the photoconductor's surface, the toner and the paper surface to enable the printing process to take place. Having the appropriate charges in the appropriate places at the appropriate times is critical to making the process work.

After the image is transferred to the paper or other recording medium, it goes to the fuser where the paper is moved through a nip where it is heated and pressed. This melts the thermoplastic portion of the toner, causing it to bond with the fibers of the paper, thereby fixing the image onto the paper or recording medium. While this is an effective way of fixing the toner image on the paper's surface, it carries with it some problems. Specifically, the simplest approach to fusing the toner is to apply a constant level of heat to the surface of the printing medium. Usually a closed loop control system is used to regulate this level of heat by controlling the temperature of the fuser hot roller or belt. Typically, a thermistor is used to sense the temperature of the fuser hot roller or the heater which heats the fuser belt. This can cause a problem when print media of various widths, such as labels, notepaper or envelopes, is fed into the printer, particularly a printer which utilizes a belt-type fuser and is reference edge fed. As used herein, "reference edge fed" means that one side of the media is always pressed against a reference surface in the printer. It is important to be able to feed media of various lengths and widths without incurring damage to the fuser. When feeding narrow print media, such as labels, notepaper or envelopes, the non-media side of the fuser will lose the thermal mass and heat-sinking effect of the media as it passes through the fuser nip, while the media side of the fuser will have the media to absorb some of the heat generated. This creates a non-uniform temperature profile along the axis of the heater since the thermistor will be controlling the temperature from a position on the heater covered by the media. As the media gets longer, heavier, and narrower, the difference in temperature between the media and non-media sides of the fuser increases significantly.

In hot-roller fuser mechanisms, the thermal mass of the hollow aluminum fuser roller provides a sufficient conduction path for the excess energy to flow from the non-media to the media side of the roller, thus avoiding damagingly high temperatures in the fuser. However, in belt fusers, the heating system has a very low thermal mass that does not create a good conduction path for the excess energy. Instead, the excess energy is driven into the fuser belt, heater housing and back-up roller, which cannot safely handle the damaging effects of the high temperatures. This can cause damage to the printer and the pages being printed. Given business demands, which require that belt fusers be able to feed all widths of print media safely, there is a need to be able to control fuser temperatures in the presence of narrow media. The present invention addresses this need in a very simple, inexpensive and effective manner.

The issue of controlling heat in the fuser when narrower print media is utilized has been addressed in the prior art. However, these approaches do not utilize the straightforward approach defined in the present invention.

U.S. Pat. No. 5,289,247, Takano, et al., issued Feb. 22, 1994, addresses the problem of fuser overheating in non-contact areas where narrower print media is fed into the printer. In this approach, the circuitry in the printer includes preset fuser heater temperatures and preset intervals at which print media is fed into the printer. The problem of higher temperatures when narrower print media is used is addressed by either moving to lower preset feeding speeds for the narrower print media, lower preset fuser roller temperatures, or preset intervals during which no print media is moved through the fuser. In the course of this approach, the fuser heater is turned on and off during the printing process, but this is done to achieve and maintain the preset temperatures which are programmed into the printer circuitry.

U.S. Pat. No. 5,315,350, Hirobe, et al., issued May 24, 1994, describes printer circuitry developed to utilize electricity as efficiently as possible during the fusing process. The Hirobe, et al. invention does not deal with fuser overheating caused by narrow print media being fed through the fuser. In this procedure, the heater for the fixing roll is turned on and off in order to keep the fixing roll temperature within a predetermined range. By doing this, the appropriate fixing temperature can be achieved without requiring that large surges of electricity be fed into the printer. A conversion table is utilized in the circuitry in order to determine how long the heater is to be left on to achieve these predetermined target temperatures, based on the current temperature of the roller.

U.S. Pat. No. 5,621,511, Nakayama, issued Apr. 15, 1997, relates to a procedure for adjusting the temperature of the fixing roller in a fuser without requiring that the copying time be extended. In this procedure, the power is adjusted on and off to maintain the fuser temperature within a fixed range, while the fuser mechanism adjusts the sheet feeder interval based on the temperature of the fixing device and the number of remaining sheets to be printed.

U.S. Pat. No. 5,669,039, Ohtsuka, et al., issued Sep. 16, 1997, describes a procedure for maintaining a uniform fuser belt temperature when media of different widths are fed into the fuser mechanism. This is accomplished by varying the level of electric power to the heater and the feed interval of media into the fuser.

It has now been found that by turning down or turning off the power to the fuser heater when a piece of narrow gauge printing media has exited the fuser nip, the problem of fuser belt overheating caused by such media can be overcome. This approach can be further enhanced by incorporating into the fuser a mechanism which periodically measures the temperature of the heater, when the heater is turned down or turned off; determining the amount of time it will take for the next piece of printing media to enter the fuser nip; and then reactivating power to the heater based on the amount of time it will take the heater to move from its current temperature to its operational temperature in view of the amount of time remaining before the next item enters the fuser nip.

SUMMARY OF THE INVENTION

The present invention encompasses an image-fixing apparatus comprising:

a heater which is stationary in use;

a film slideable on said heater;

a back-up member which cooperates with said heater to form a nip, with said film being interposed between said back-up member and said heater, wherein an image carried on a recording medium is heated through said film while in the nip by heat from said heater;

a detection means which detects whether a particular recording medium to enter the nip is of narrow gauge; and a control means which decreases the power to said heater (and preferably turns said heater off) when a recording medium of narrow gauge has exited or is about to exit the nip and reactivates said heater prior to the next recording medium entering the nip.

In a preferred embodiment, the image-fixing apparatus described above additionally comprises:

a means for measuring the temperature of the heater, when said heater is deactivated, at predetermined intervals;

a means for calculating the amount of time required for the heater to reach its operational temperature from its measured temperature (ramp time);

a means for determining, at predetermined intervals, the amount of time it will take the next recording medium to enter the nip (transit time); and a control means which reactivates said heater when the ramp time is greater than or equal to its corresponding transit time.

Finally, the present invention encompasses a method for fixing images on narrow-gauge recording media using an image-fixing apparatus comprising a heater which is stationary in use; a film slideable on said heater; and a back-up member which cooperates with said heater to form a nip, with said film being interposed between said back-up member and said heater, when an image carried on a recording medium is heated through said film while in the nip by heat from said heater; comprising the following steps:

determining whether the recording medium being fed into the fixing apparatus is of narrow gauge;

deactivating said heater (preferably turning said heater off) when a recording medium of narrow gauge has exited or is about to exit the nip;

measuring the temperature of the heater, when said heater is deactivated, at predetermined intervals;

calculating the amount of time required for the heater to reach its operational temperature from its measured temperature (ramp time);

determining, at predetermined intervals, the amount of time it will take the next recording medium to enter the nip (transit time);

reactivating said heater when the ramp time is greater than or equal to its corresponding transit time; and repeating the process for each narrow gauge recording medium to be fed into the image-fixing apparatus.

DETAILED DESCRIPTION OF THE INVENTION

The present invention relates to an apparatus and a method for controlling the fuser temperature when pieces of recording media of narrow gauge are fed through an electrophotographic printer. By decreasing the output of the fuser belt heater or turning the fuser belt heater off when narrow gauge media exits or is about to exit from the fuser, and then bringing the heater output to its original level in a carefully controlled manner as the next piece of narrow gauge print media approaches the fuser nip, the temperature can be controlled in a very easy and effective way, avoiding the hazards of overheating without requiring that major changes be made in either the structure or circuitry of the printer.

Figure 1:
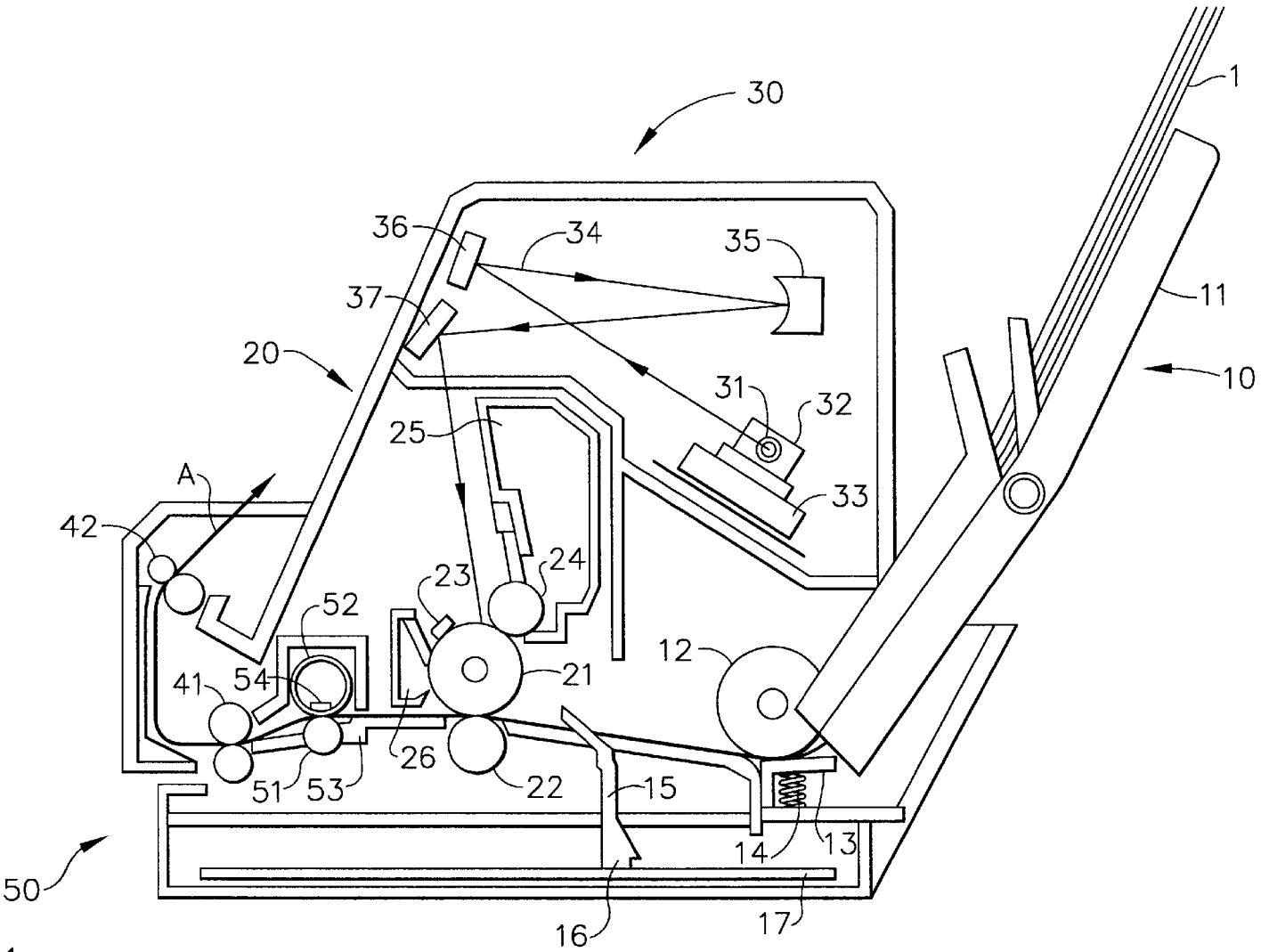
FIG. 1 is a schematic view of a laser printer representing a typical electrophotographic apparatus, particularly one used in a desktop printer or copier.

A standard design for a laser printer, a representative electrophotographic device, is shown in FIG. 1. It includes a paper feed section (10), an image-forming device (20), a laser scanning section (30), and a fixing device (50). The paper feed section (10), sequentially transports sheets of recording paper (or other printing media) (1) to the image-forming device (20) provided in the printer. The image-forming device (20) transfers a toner image to the transported sheet of recording paper (1). The fixing device (50) fixes toner to the sheet of recording paper (1) sent from the image-forming device (20). Thereafter, the sheet of recording paper (1) is ejected out of the printer by paper transport rollers (41, 42). In short, the sheet of recording paper (1) moves along the path denoted by the arrow (A) in FIG. 1. It is to be understood that, as used herein, the terms "recording paper" or "paper" is intended to include any and all recording/printing media which may be fed through an electrostatic printer (e.g., paper, transparencies, labels, envelopes, notepaper).

The paper feed section (10) includes a paper feed tray (11), a paper feed roller (12), a paper separating friction plate (13), a pressure spring (14), a paper detection actuator (15), a paper detection sensor (16), and a control circuit (17).

Upon receiving a print instruction, the sheets of recording paper (or other printing media) (1) placed in the paper feed tray (11) are fed one-by-one into the printer by operation of the printer feed roller (12). The paper separating friction plate (13) and the pressure spring (14). As the fed sheet of recording paper (1) pushes down the paper detection actuator (15), the paper detection sensor (16) outputs an electrical signal instructing commencement of printing of the image. The control circuit (17), started by operation of the paper detection actuator (15) transmits an image signal to a laser diode light-emitting unit (31) of the laser scanning section (30) so as to control on/off of the light-emitting diode.

The laser scanning section (30) includes the laser diode light-emitting unit (31), a scanning mirror (32), a scanning mirror motor (33), and reflecting mirrors (35, 36 and 37).

The scanning mirror (32) is rotated at a constant high speed by the scanning mirror motor (33). In other words, laser light (34) scans in a vertical direction to the paper surface of FIG. 1. The laser light (34) radiated by the laser diode light-emitting unit (31) is reflected by the reflecting mirrors (35, 36 and 37) so as to be applied to the photosensitive body (21). When the laser light (34) is applied to the photosensitive body (21), the photosensitive body (21) is selectively exposed to the laser light (34) in accordance with on/off information from this control circuit (17).

The image-forming device (20) includes the photosensitive body (21), a transfer roller (22), a charging member (23), a developing roller (24), a developing unit (25), and a cleaning unit (26). The surface charge of the photosensitive body (21), charged in advance by the charging member (23) is selectively discharged by the laser light (34). An electrostatic latent image is thus formed on the surface of the photosensitive body (21). The electrostatic latent image is visualized by the developing roller (24), and the developing unit (25). Specifically, the toner supplied from the developing unit (25) is adhered to the electrostatic latent image on the photosensitive body (21) by the developing roller (24) so as to form the toner image.

Toner used for development is stored in the developing unit (25). The toner contains coloring components (such as carbon black for black toner) and thermo-plastic components. The toner, charged by being appropriately stirred in the developing unit (25), adheres to the above-mentioned electrostatic latent image by an interaction of the developing bias voltage applied to the developing roller (24) and an electric field generated by the surface potential of the photosensitive body (21), and thus conforms to the latent image, forming a visual image on the photosensitive body (21). The toner typically has a negative charge when it is applied to the latent image, forming the visual image.

Next, the sheet of recording paper (1) transported from the paper feed section (10) is transported downstream while being pinched by the photosensitive body (21) and the transfer roller (22). The paper (1) arrives at the transfer nip in timed coordination with the toned image on the photosensitive body (21). As the sheet of recording paper (1) is transported downstream, the toner image formed on the photosensitive body (21) is electrically attracted and transferred to the sheet of recording paper (1) by an interaction with the electrostatic field generated by the transfer voltage applied to the transfer roller (22). Any toner that still remains on the photosensitive body (21), not having been transferred to the sheet of recording paper (1), is collected by the cleaning unit (26). Thereafter, the sheet of recording paper (1) is transported to the fixing device (50). In the fixing device (50), an appropriate temperature and pressure are applied while the sheet of recording paper (1) is being pinched by moving through the nip formed by a pressure roller (51) and the fixing roller or belt (52) that is maintained at an elevated temperature. The thermoplastic components of the toner are melted by the fuser belt (52) and fixed to the sheet of recording paper (1) to form a stable image. The sheet of recording paper (1) is then transported and ejected out of the printer by the printer transport rollers (41, 42).

Next, the operation of the fixing device (50) will be described in detail. The fixing device (50) includes the back-up (or pressure) roller (51) and the fixing roller or fixing belt (52). The present invention relates to the embodiment where the fixing device (50) utilizes a fixing belt because it is only there that the use of narrow gauge print media will result in a thermal heating imbalance. This is because the fixing roller is generally made from a metal material, such as aluminum. The aluminum has a high thermal mass and acts as a heat sink effectively preventing overheating when narrow gauge print media are utilized. Since the fuser belt is made from a very thin non-metallic, low thermal mass material, such as a polyimide, it cannot serve as a heat sink and the presence of narrow gauge print media in the fuser can, as previously described, result in a temperature imbalance and an overheating of the fuser.

The fixing belt is generally an endless belt or tube formed from a highly heat resistive and durable material having good parting properties and a thickness of not more than about 100 $\mu$m, preferably not more than about 70 $\mu$m. Preferred belts are made from a polyimide film. The belt may have an outer coating of, for example, a fluororesin or Teflon material to optimize release properties of the fixed toner from the belt. Such fuser belts are well-known in the art. A heater (54), generally a ceramic heater, is placed on the inside surface of the belt and the outside surface of the belt forms a fusing nip with the back-up roller (51) at the location of the heater. Put another way, the heater (54) and the back-up roller (51) form the nip, with the fuser belt (52) interposed between them. Each page carrying the toner travels through this nip (i.e., between the fuser belt (52) and the back-up roller (51)) and the toner is fixed on the page through the combination of applied heat, the time the page is in the fuser nip, and pressure. Typically, the pressure between the fuser belt (52) and the back-up roller (51) at the fuser nip is from about 5 to about 30 psi. While the fuser belt (52) may be driven itself, often this is not the case. Generally, the back-up roller (51) is rotated and it is the friction between the surface of the back-up roller (51), and the printed page and ultimately the surface of the fuser belt (52), which causes the fuser belt (52) to rotate.

The backup or pressure roller (51) is cylindrical in shape. It is made from or is coated with a material that has good release and transport properties for the recording paper (1). The backup roller (51) is sufficiently soft so as to allow it to be rotated against the fuser belt (52) to form a nip through which the printed pages travel. By going through this nip, printed pages are placed under pressure and the combined effects of this pressure, the time the page is in the nip, and the heat from the fuser belt (52) acts to fix the toner onto the paper. A preferred material for use in forming the backup roller (51) is silicone rubber. The roller typically has an aluminum core with a silicone rubber layer molded or adhesively bonded onto its surface. This roller may also have a fluoropolymer (e.g., Teflon) sleeve or coating. In a preferred embodiment, the backup roller is essentially hollow, having a metallic core, an outer metallic shell surrounding and essentially concentric with the core, and ribs between the core and the outer shell. In this embodiment, the backup roller (51) has reduced thermal mass which results in reduced moisture condensing on it. In another embodiment, a wiper coated with a high surface energy material is used to remove moisture from the surface of the back-up roller (51).

The essence of the present invention relates to the design of the fuser and the process utilized for fusing which carefully controls the temperature of the fuser so that fusing of narrow gauge print media does not result in overheating of the fuser belt. As used herein, the term "narrow gauge print media" is intended to include any print media which is significantly narrower than standard paper, i.e., significantly more narrow than 8.5" in width. Narrow gauge print media generally will have widths of no greater than about 7.5 inches, preferably no greater than about 7.25 inches. Examples of such media include notepaper, envelopes, labels, executive-size paper, and B-5 paper. These print media will generally be made from paper, but can be made from any material conventionally used in a printing process, such as acetate transparencies, kevlar envelopes or various plastic materials.

Figure 2:
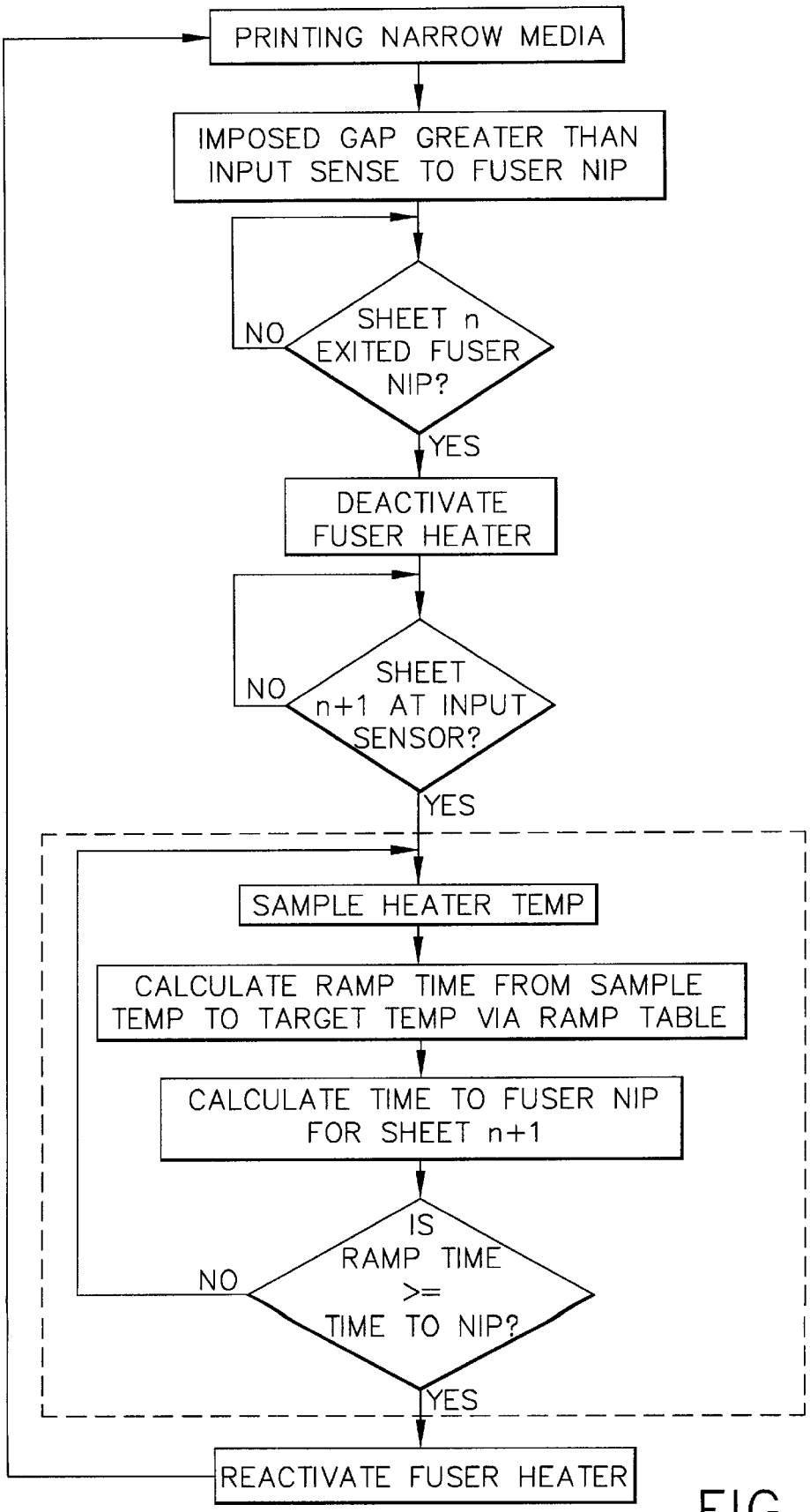
FIG. 2 is a flowchart illustrating the method for fixing images on narrow gauge recording media of the present invention.

The essence of the present invention is illustrated in the flow chart given in FIG. 2. The present invention solves the problem of over-heating during the printing of narrow gauge print media by reducing the fuser heater output or turning off the fuser heater (54) during larger imposed gaps when printing a narrow media job. This control is further optimized by timing the activation of the fuser heater such that it reaches its optimum fuser temperature just when the next piece of print media (1) reaches the fuser nip.

The printer includes a sensor which detects whether narrow gauge media is being fed into it. This sensor may be located anywhere in the paper feed path, generally upstream from the fuser, for example from about 6 to about 7.5 inches, preferably about 6.7–6.8 inches, from the reference edge of the printer. The process of the present invention only applies where the print media being fed is narrow gauge. With imposed gaps greater than the distance from the input sensor to the fuser nip (generally greater than about 7"), the fuser heater is turned to a lower preset temperature or, preferably, turned off once a narrow gauge sheet exits or is about to exit the fuser nip. As used herein, the term "deactivation" is intended to include both turning the heater to a lower preset temperature setting (i.e., decreasing the heater output) and turning the heater off. Additionally, as used herein, the term "exits the fuser nip" not only includes the point at which a piece of print media actually leaves the nip, but also includes the point at which the printing operation has been completed on a particular piece of print media and no further fusing is required on it (even if it has not yet fully exited the nip). When the heater is turned to a lower setting or shut off, heat flows from the non-media side of the fuser belt (i.e., that portion of the belt which did not contact the narrow gauge sheet) to the cooler media side (i.e., that portion of the belt which contacts the narrow gauge sheet) primarily using the backup roller (51) as its conduction path. This acts to cool the non-media side and prevents the fuser from reaching damaging temperatures.

In preferred embodiments, when the next (narrow gauge) sheet triggers the input sensor, the machine will begin sampling the heater temperature at predetermined periods of time (e.g., at intervals of from about 0.001 to about 0.1 seconds, most preferably about every 0.011 seconds). At each sampling point, the sample temperature of the fuser is compared to the target optimum fuser temperature, generally using a preloaded table, to determine how much time is needed to bring the fuser from its current temperature to the optimum temperature (ramp time). The optimum fuser temperature is generally from about 130 to about 220° C., depending on the paper transit speed. This time is then compared to the remaining time it will take the leading edge of the narrow gauge sheet currently being fed into the machine to reach the fuser nip (transit time). This sampling continues at regular intervals, as defined above, and is signified by the dashed box in the flow chart. The transit time may be actually measured using sensors in the printer or calculated based on the (elapsed) time since the sheet first hit the input sensor and the speed at which the sheet is being fed. Once the predicted ramp time exceeds or equals a predefined window of the time to the fuser nip (transit time), the heater is turned back on or reset to its original higher setting ("reactivated"). In a preferred embodiment, the heater is turned back on (reactivated) when the ramp time is greater than or equal to its corresponding transit time, most preferably it will be turned back on when the ramp time is equal to its corresponding transit time. The fuser will be at the appropriate fusing temperature by the time the narrow gauge sheet reaches the nip. This method ensures that the print media is adequately fused while maintaining safe operating temperatures on the non-media side of the fuser. Although the discussion in this section has been in terms of time measurements, it will be appreciated that the controlling events can be ones of distance, rather than time (e.g., based on a counting of the feed motor pulses). Both are intended to be covered by the present application, since they are equivalents.

Figure 3:
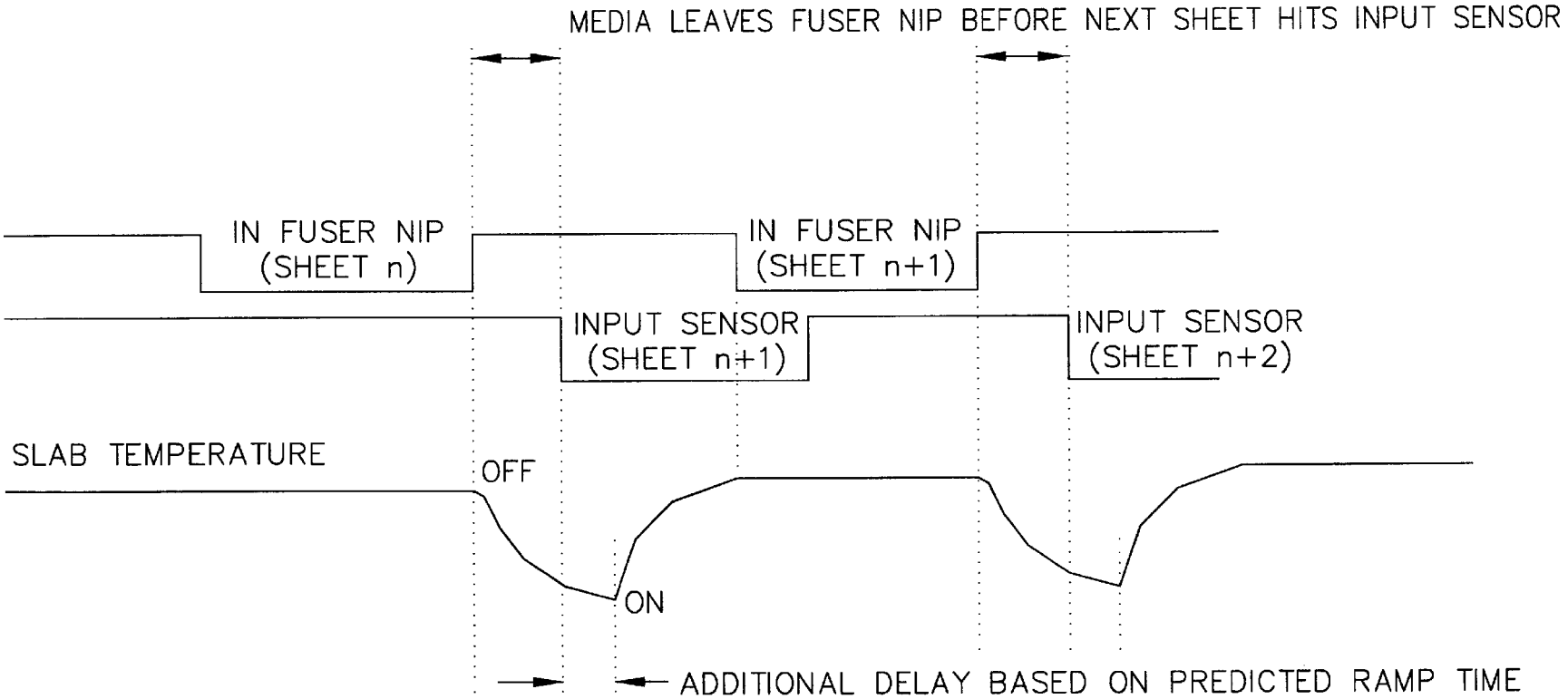
FIG. 3 is a timing diagram which illustrates the actual usage of the apparatus and method of the present invention.

FIG. 3 is a timing diagram which illustrates the use of the apparatus and the method of the present invention. In this diagram, the horizontal axis represents consecutive time, the top line represents the time periods during which consecutive sheets of print media are in the fuser nip, the second line indicates the time periods during which consecutive sheets of print media are at the initial input sensor, and the third line represents the temperature at the fuser nip (the vertical axis represents increasing temperature). Thus, it will be seen that when each consecutive sheet of narrow gauge print media leaves the fuser nip, the fuser heater is turned off (or turned down to a preset temperature setting). This allows heat to flow from the non-media side of the fuser belt (52) to the cooler media side, primarily using the back-up roller (51) as the conduction path. If this was not done, the fuser temperature in the non-media side would continue to rise during the period when no print media was in the fuser nip, causing a particular problem for the non-media side of the fuser belt which has a relatively high temperature to begin with. When the next sheet of narrow gauge print media moves to the input sensor, the machine calculates how much time will be needed to bring the current fuser temperature to the optimum temperature required for fusing and, at the appropriate point, the fuser heater is restored to its original temperature or turned back on (reactivated) and the fuser temperature begins to rise to that optimum level. In the third line of FIG. 3, it will be noted that there is a time lag between the time that the sheet triggers the input sensor and the fuser heater is turned on. During this time lag, additional cooling of the non-media side of the fuser belt takes place and the temperature of the heater (54) is sampled to determine how much time is needed to bring the fuser from its current temperature to its optimum fusing temperature (ramp time). Also, it will be noted from the third line of FIG. 3, that the fuser temperature reaches the optimum temperature at the point at which the next sheet of print media enters the fuser nip. This process is repeated for as long as sheets of narrow gauge media are fed into the printer. The presence of narrow gauge media is determined by a sensor in the feed mechanism of the printer.

The illustrations shown in the present application are only intended to be illustrative of the present invention and not limiting thereof. The full scope of the present invention is defined by the following claims and equivalents thereof.

What is claimed is:

1. An image-fixing apparatus comprising:

a heater which is stationary in use;

a film slideable on said heater;

a backup member which cooperates with said heater to form a nip, with said film being interposed between said backup member and said heater, wherein an image carried on a recording medium is heated through said film while in the nip by heat from said heater;

a detection means which detects whether a particular recording medium to enter the nip is of narrow gauge; and a control means which deactivates said heater when a recording medium of narrow gauge has exited the nip and reactivates said heater prior to the next recording medium entering the nip.

2. The image-fixing apparatus according to claim 1 wherein the control means turns said heater off when a recording medium of narrow gauge has exited the nip.

3. The image-fixing apparatus according to claim 1 which additionally comprises:

a means for measuring the temperature of the heater, when said heater is deactivated, at predetermined intervals;

a means for calculating the amount of time required for the heater to reach its operational temperature from its measured temperature (ramp time);

a means for determining, at predetermined intervals, the amount of time it will take the next recording medium to enter the nip (transit time); and a control means which reactivates said heater when the ramp time is greater than or equal to its corresponding transit time.

4. The image-fixing apparatus according to claim 2 which additionally comprises:

a means for measuring the temperature of the heater, when said heater is turned off, at predetermined intervals;

a means for calculating the amount of time required for the heater to reach its operational temperature from its measured temperature (ramp time);

a means for determining, at predetermined intervals, the amount of time it will take the next recording medium to enter the nip (transit time); and a control means which turns said heater on when the ramp time is greater than or equal to its corresponding transit time.

5. The image-fixing apparatus according to claim 4 wherein the temperature of the heater is measured at intervals of from about 0.001 to about 0.1 seconds.

6. The image-fixing apparatus according to claim 5 wherein the heater is a ceramic heater.

7. The image-fixing apparatus according to claim 6 wherein the film is a polyimide belt having a thickness of no greater than about 100 $\mu$m.

8. The image-fixing apparatus according to claim 7 wherein the backup member is an aluminum backup roller.

9. The image-fixing apparatus according to claim 8 wherein the temperature of the heater is measured at intervals of about 0.011 seconds.

10. A method for fixing images on narrow gauge recording media using an image-fixing apparatus comprising a heater which is stationary in use; a film slideable on said heater; and a backup member which cooperates with said heater to form a nip, with said film being interposed between said backup member and said heater, wherein an image carried on a recording medium is heated through said film while in the nip by heat from said heater; comprising the following steps;

determining whether the recording medium being fed into the fixing apparatus is of narrow gauge;

deactivating said heater when a recording medium of narrow gauge has exited the nip;

measuring the temperature of the heater, when said heater is deactivated, at predetermined intervals;

determining the amount of time required for the heater to reach its operational temperature from its measured temperature (ramp time);

determining, at predetermined intervals, the amount of time it will take the next recording medium to enter the nip (transit time);

activating said heater when the ramp time is greater than or equal to its corresponding transit time; and repeating the process for each narrow gauge recording medium to be fed into the image-fixing apparatus.

11. The method according to claim 10 wherein the heater is turned off when a recording medium of narrow gauge has exited the nip, and is turned on when the ramp time is greater than or equal to its corresponding transit time.

12. The method according to claim 11 wherein the temperature of the heater is measured at intervals of from about 0.001 to about 0.1 seconds.

13. The method according to claim 12 wherein the heater is a ceramic heater.

14. The method according to claim 13 wherein the film is a polyimide belt having a thickness of no greater than about 100 $\mu$m.

15. The method according to claim 14 wherein the backup member is an aluminum backup roller.

16. The method according to claim 15 wherein the temperature of the heater is measured at intervals of about 0.011 seconds.

17. A method for fixing images on narrow gauge recording media using an image-fixing apparatus comprising a heater which is stationary in use; a film, slideable on said heater; and a back-up member which cooperates with said heater to form a nip, with said film being interposed between said back-up member and said heater, wherein an image carried on a recording medium is heated through said film while in the nip by heat from said heater; comprising the following steps:

determining whether the recording medium being fed into the fixing apparatus is of narrow gauge;

deactivating said heater when a recording medium of narrow gauge has exited the nip; and reactivating said heater prior to the next recording medium entering the nip.

18. The method according to claim 17 wherein the heater is turned off when a recording medium of narrow gauge has exited the nip, and is turned on prior to the next recording medium entering the nip.

* * * * *